US007104425B2

(12) United States Patent
Le Roy

(10) Patent No.: US 7,104,425 B2
(45) Date of Patent: Sep. 12, 2006

(54) INTERMODAL BULK DRY PARTICULATE CARGO CONTAINER AND METHOD

(76) Inventor: Curtis W. Le Roy, P. O. Box 3401, Oak Brook, IL (US) 60522-3401

( * ) Notice: Subject to any disclaimer, the term of this patent is extended or adjusted under 35 U.S.C. 154(b) by 0 days.

(21) Appl. No.: 10/274,185

(22) Filed: Oct. 18, 2002

(65) Prior Publication Data

US 2004/0074918 A1 Apr. 22, 2004

(51) Int. Cl.
*B67D 5/06* (2006.01)

(52) U.S. Cl. ..... 222/185.1; 222/181.1; 222/624; 222/625; 220/1.5; 220/562; 414/498

(58) Field of Classification Search ..... 222/185.1, 222/181.1, 624, 625, 180; 220/1.5, 652, 220/562, 668, 608; 406/119; 410/45; 414/498, 414/812

See application file for complete search history.

(56) References Cited

U.S. PATENT DOCUMENTS 2,056,179 A * 10/1936 Fitch ..... 410/68
3,182,954 A * 5/1965 Borger ..... 406/130
3,191,785 A * 6/1965 Price ..... 406/119
3,726,431 A * 4/1973 Botkin ..... 220/1.5
4,445,624 A * 5/1984 Gill ..... 220/1.5
4,823,989 A * 4/1989 Nilsson ..... 222/630
5,083,673 A * 1/1992 Fossey ..... 220/1.5
5,624,049 A * 4/1997 Kovash et al. ..... 220/1.5
5,911,337 A * 6/1999 Bedeker ..... 220/562
5,960,974 A * 10/1999 Kee et al. ..... 220/1.5
6,418,869 B1 * 7/2002 Miller ..... 114/26
6,527,134 B1 * 3/2003 Hinkle et al. ..... 220/1.5

* cited by examiner

*Primary Examiner*—Frederick C. Nicolas
(74) *Attorney, Agent, or Firm*—Craig Barber; Barber Legal

(57) ABSTRACT

A method for loading and unloading of dry bulk freight containers vertically, and a device in the form of an improved intermodal dry bulk freight container for vertical loading and unloading. Standardized corner locks may be used and dimensions may be selected so as to provide a standardized cargo container.

The present invention teaches that an intermodal dry bulk freight container may be loaded in either the customary horizontal orientation of such devices, or in a vertical orientation in which one end is opened and elevated. In particular, however, such a container may advantageously be emptied by elevating it into the vertical orientation. The method of the invention is thus to provide only a single hopper and yet allow one hopper to empty the entire container, as well as providing a more efficient gravity feed of bulk cargo as it is off loaded.

The present invention furthermore teaches an intermodal dry bulk freight container suitable for this method of operation. In the presently preferred embodiment, the container is loaded conventionally via hatches on the top of the container when it is in a horizontal orientation, but is unloaded via a single hopper located at the lower end when the container is raised into the vertical orientation.

8 Claims, 14 Drawing Sheets

INTERMODAL BULK DRY PARTICULATE CARGO CONTAINER AND METHOD

FIELD OF THE INVENTION

This invention relates generally to shipping containers and more specifically to intermodal bulk dry shipping containers for bulk dry particulate matter.

BACKGROUND OF THE INVENTION

In order to reduce the cost, time and manpower of long distance shipping, the cargo container is commonly used. Such containers are standardized shapes and sizes and usually have standardized handling devices such as standardized grips, hooks, tie downs and so on that allow shippers, handlers, stevedores, longshoreman, truckers and others to handle numerous containers quickly, almost regardless of the actual contents of the containers.

Normally, such containers are built to specifications issued by various authorities: international use of containers built to these specifications is one of the key ingredients of the modern free trade system, for without such standards, fast handling would be almost impossible.

Perhaps the foremost authority for issuance of such standards is the ISO or International Standards Organization, which issues numbered standards directives. For example "ISO 1496/IV" is one standard for cargo containers, "ISO 1161" another standard for the corner locks of such containers and so on. The Association of American Railroads has similar standards on the same topic, for example AAR M-930. These standards most importantly relate to dimension, but also relate to weatherability, strength and other issues.

Shipping of bulk powders can be a surprisingly aggravating proposition, even when such standardized cargo containers are utilized. Firstly, they are collectively amorphous so entirely closed containers are necessary. Powders and dry particulate matter in general tend to behave in a fashion that allows such bulk powders as food products (e.g. Grain, Flour, Sugar, Dextrose, Starch, Cake Mixes, Cocoa, Coffee, Enzymes, Nutrients, Feeds, Pet Foods, Seeds, Spices, et al.) Chemicals, (e.g. Sodium Chloride, Calcium Chloride, Calcium Carbonate, Lime, Urea, polyethylene, polypropylene, polyester, cements, adhesives, compounds, et al.) Minerals, (e.g. Clays, Fuels, Soils, Stone, et al.). However, such bulk dry particulates or powders usually have an angle of repose, even if a small one, that is there is some angle from the horizontal at which a bulk powder or particulate will rest without flowing, unlike true liquids. Thus, shipping containers for bulk powders tend to have non-flat bottoms. In commonly seen schemes, the container may be subdivided into several smaller compartments, each one with its own "chute" section on the bottom surface of the horizontal container. There are, however, disadvantages to such designs.

One disadvantage is that the numerous small chutes normally used decreased cargo capacity of the container. Switching to one large chute on the bottom side of the container would merely exacerbate this problem under the dictates of simple geometry.

Flow problems also arise: the typical dry particulate matter has a degree of friction which tends to impede or even block flow, while the typical container is not arranged so as to permit the easy discharge of such bulk particulate matter. These problems and other problems stem from the fact that there is no large vertical drop possible within a normal container. The typical standardized container is a matter of 8 feet to 9.5 feet in height (roughly 2400 to 2900 millimeters). This cannot be increased without defeating the entire purpose for having standardized cargo containers.

Pockets or irregularities in such containers also cause retention of portions of the bulk cargo, forcing manual cleaning of the container to finish the unloading of the cargo, or even worse, posing the risk of contamination of the next cargo.

Various types of bulk cargo containers are known, and have various defects.

Those made of inherently strong materials such as heavy gauge steel plate are excessively heavy in relation to the cargo to be carried, not to mention excessively expensive to manufacture. But containers having internal frames tend to provide numerous catch basins or pockets requiring manual cleaning as described above. Containers having external frames eliminate this problem at the cost of reducing the cargo capacity of the container by the depth of the framework on all sides (because of course the framework must fit within the dimensional standards of the container and therefore the "external" frame is actually inside the edges of the container envelope, thus forcing the container itself to sit within the frame). Containers have been made of fiber reinforced plastic materials (sheets of somewhat flexible material of great strength) with external frames have been tried with limited success: potentially decreased weight but potentially decreased durability.

Various examples may be considered. U.S. Pat. No. 6,401,983 B1 issued Jun. 11, 2002 to McDonald et al for BULK CARGO CONTAINER is an example of one such. It uses a conventional horizontal container and a conventional vertical flow path: bulk materials are loaded from above through doors 138, 140 and 142 and unloaded from beneath through discharge openings such as 116.

U.S. Pat. No. 6,059,372 issued May 9, 2000 to McDonald et al for HOPPER BOTTOM TRAILER shows much the same thinking at work: a conventionally horizontal container, possibly subdivided into compartments or cells and a conventional top-in and bottom-out flow path for the bulk materials handled.

U.S. Pat. No. 5,960,974 issued Oct. 5, 1999 to Kee et al for INTERMODAL BULK CONTAINER teaches a container vessel of aluminum within a rigid outer frame with hoppers extending out the bottom of the device and domed aluminum sealing the ends. Hoppers within the shell are once again to be filled from the top and emptied from the bottom.

U.S. Pat. No. 5,529,222 issued Jun. 25, 1996 to Toth et al for DRY BULK PRESSURE DIFFERENTIAL CONTAINER WITH EXTERNAL FRAME SUPPORT teaches exactly that, once again in a substantially horizontal mode.

All of these devices attempt to overcome the friction of the bulk cargo they carry in fairly standard ways. One method is to apply pressure to the air or gaseous atmosphere within the container, i.e. blowing into it, so as to aid the "liquification" of the bulk product and speed flow out through bottom hoppers. This method might allow loading from the bottom as well. The result is a great deal of "plumbing" at the bottom of the device which tends to increase cost and time of manufacture. In addition, the handling facilities at which the container loads and unloads must be equipped to provide such an air pressure differential and having suitable couplings to link to the container's "plumbing" system. Another common solution is to provide relatively highly angled (steep) sided hoppers at the bottom of the vessel, once again however simple geometry dictates that this solution reduces the cargo capacity of the container.

It would be greatly desirable to provide a method of gravity feed of the contents of a bulk cargo container and yet achieve good flow, without overly compromising cargo capacity, and while allowing the additional use of the various devices listed above if desired.

SUMMARY OF THE INVENTION

General Summary

The present invention teaches that an intermodal dry bulk freight container may be loaded in either the customary horizontal orientation of such devices, or in a vertical orientation in which one end is opened and elevated. In particular, however, such a container may advantageously be emptied by elevating it into the vertical orientation. The method of the invention is thus to provide only a single hopper and yet allow one hopper to empty the entire container, as well as providing a more efficient gravity feed of the bulk cargo as it is off loaded.

The present invention furthermore teaches an intermodal dry bulk freight container suitable for this method of operation. In the presently preferred embodiment, the container is loaded conventionally via hatches on the top of the container when it is in a horizontal orientation, but is unloaded as a single entity (from the lower end) when the container is raised into the vertical orientation.

Summary in Reference to Claims

It is thus a first aspect, embodiment, advantage and object of the invention to provide a bulk dry particulate cargo container comprising: a plenum having a top and a first end, the plenum further having at least one chute located at the first end; the plenum further having at least one feed hatch located at the top, the container having strength sufficient to withstand being elevated from a horizontal orientation to an at least partially vertical orientation while loaded with such cargo.

It is thus another aspect, embodiment, advantage and object of the invention to provide a cargo container further comprising: a framework, the plenum supported by the framework and gaining from the framework said strength sufficient to withstand being elevated from a horizontal orientation to an at least partially vertical orientation while loaded with such cargo.

It is thus another aspect, embodiment, advantage and object of the invention to provide a cargo container wherein the framework is external to the plenum.

It is thus another aspect, embodiment, advantage and object of the invention to provide a cargo container further comprising: a cradle having a cradle framework, the cradle being dimensioned and configured to receive and support the plenum into the cradle, and wherein the plenum is supported by the cradle framework and gains from the cradle framework said strength sufficient to withstand being elevated from a horizontal orientation to an at least partially vertical orientation while loaded with such cargo.

It is thus another aspect, embodiment, advantage and object of the invention to provide a cargo container further comprising: a cradle having a cradle framework, the cradle being dimensioned and configured to receive and support the plenum into the cradle, the cradle further comprising at least two hinge plates located one each at each lower corner of the first end of the cargo container when the cargo container is present in the cradle.

It is thus another aspect, embodiment, advantage and object of the invention to provide a cargo container further comprising: an erector dimensioned and configured to receive and support the cradle, the erector having at least two hinge blocks and at least one hinge shaft supported between the hinge blocks, the hinge shaft being dimensioned and configured such that when the erector receives and supports the cradle, the hinge plates rest upon the hinge shaft and may rotate freely therewith.

It is thus another aspect, embodiment, advantage and object of the invention to provide a cargo container wherein the chute further comprises: a closure selected from the group consisting of: slide gate, valve, gate, door, hatch, and combinations thereof; the closure having at least a first closed position in which dry particulate bulk cargo may not flow out of the container via the chute and a second open position in which dry particulate bulk cargo may flow out of the container at a first rate of flow.

It is thus another aspect, embodiment, advantage and object of the invention to provide a cargo container wherein the closure further has a third intermediate position in which dry particulate bulk cargo may flow out of the container at a second rate of flow.

It is thus another aspect, embodiment, advantage and object of the invention to provide a cargo container further comprising: an access door, dimensioned and configured for convenient human access to the plenum.

It is thus another aspect, embodiment, advantage and object of the invention to provide a cargo container wherein the framework further comprises: a plurality of standardized corner locks.

It is thus another aspect, embodiment, advantage and object of the invention to provide a cargo container wherein the framework further comprises: at least one beam dimensioned and configured to receive a lifting device, the beams having strength sufficient to support the container while the container is elevated from a horizontal orientation to an at least partially vertical orientation while loaded with such cargo.

It is thus another aspect, embodiment, advantage and object of the invention to provide a cargo container wherein the erector further comprises: a plurality of load cells, wherein the weight of the erector, cradle, container and cargo rest upon the load cells, and wherein the load cells further comprise at least one scale to measure one member selected from the group consisting of: the weight resting upon the load cells, the incremental weight change of the container, and combinations thereof.

It is thus another aspect, embodiment, advantage and object of the invention to provide a method of transporting bulk dry particulate cargo using a container transport vehicle and a container having a top and a first end and a second end, the method comprising the steps of: a) orienting such container horizontally on such transport vehicle; b) filling such container from such top; c) transporting such container on such transport vehicle; d) elevating such second end of such container; e) discharging such container from such first end.

It is thus another aspect, embodiment, advantage and object of the invention to provide a a method further comprising the step of f) placing such container into a cradle prior to step d) above.

It is thus another aspect, embodiment, advantage and object of the invention to provide a method wherein the step of d) elevating such second end of such container further comprises using an erector to elevate such second end of such container.

It is thus another aspect, embodiment, advantage and object of the invention to provide a method wherein the step of d) elevating such second end of such container further comprises elevating such second end of such container until such container is substantially vertical.

It is thus another aspect, embodiment, advantage and object of the invention to provide a method wherein the step of e) discharging such container from a first end further comprises discharging such container by means a chute located at such first end of such container.

It is thus another aspect, embodiment, advantage and object of the invention to provide a method wherein the step of e) discharging such container from a first end further comprises discharging such container by means of a chute located at such first end of such container and a closure located at such chute.

DETAILED DESCRIPTION

Figure 1:
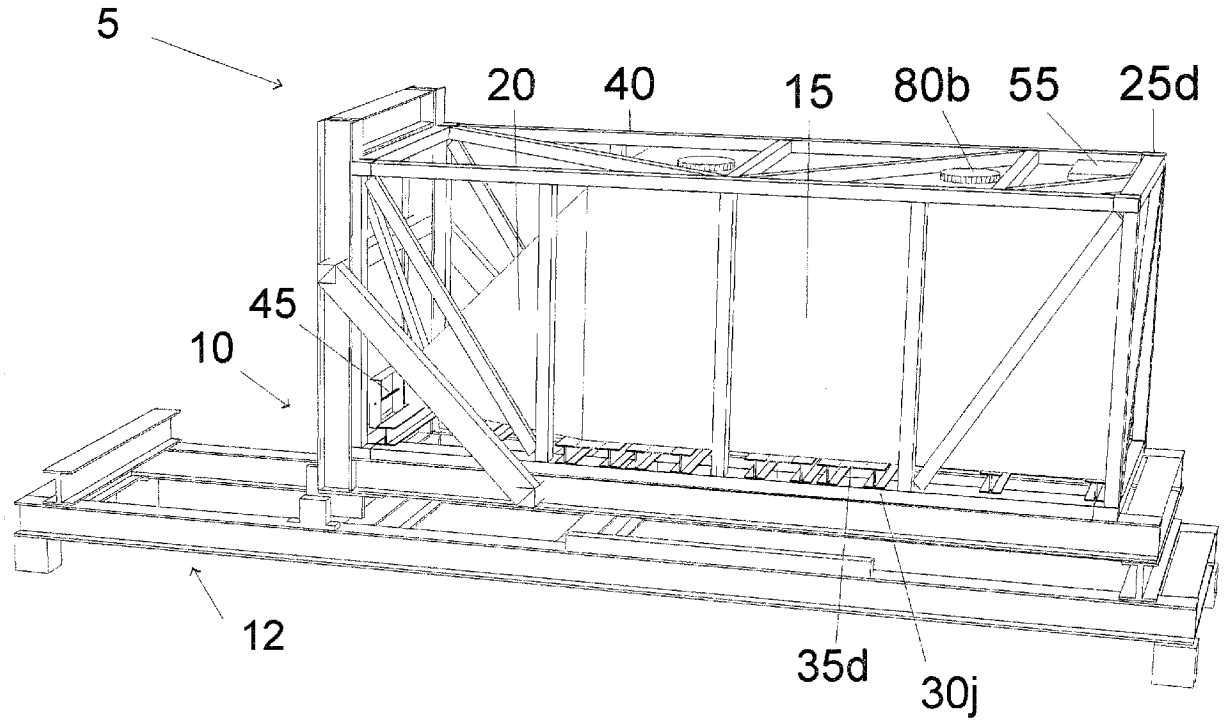
FIG. 1 is a perspective view of the container of the invention in a shipping cradle with the container and cradle in a lifting mechanism, according to the presently preferred embodiment and best mode now contemplated.

FIG. 1 is a perspective view of the container of the invention in a shipping cradle with the container and cradle in a lifting mechanism, according to the presently preferred embodiment and best mode now contemplated. Container 5 sits in cradle 10, which in turn sits upon erector 12. Container 5 consists in major part of plenum 15, chute 20, corner lock 25*d* (corner lock 25*d* is exemplary in FIG. 1, in other diagrams other corner locks are identified), exemplary center beam 30*j*, exemplary bridge beam 35*d*, frame 40, slide gate 45, exemplary feed hatch 50*b*, and access door 55. Container 5 is oriented in a substantially horizontal manner so that it conforms to ISO, AAR, or other standards for container sizes. Chute 20 is located at a first end of plenum 15, a second end of plenum 20 and container 5 is to be elevated at the time of discharge or "draining" of container 5.

Figure 2:
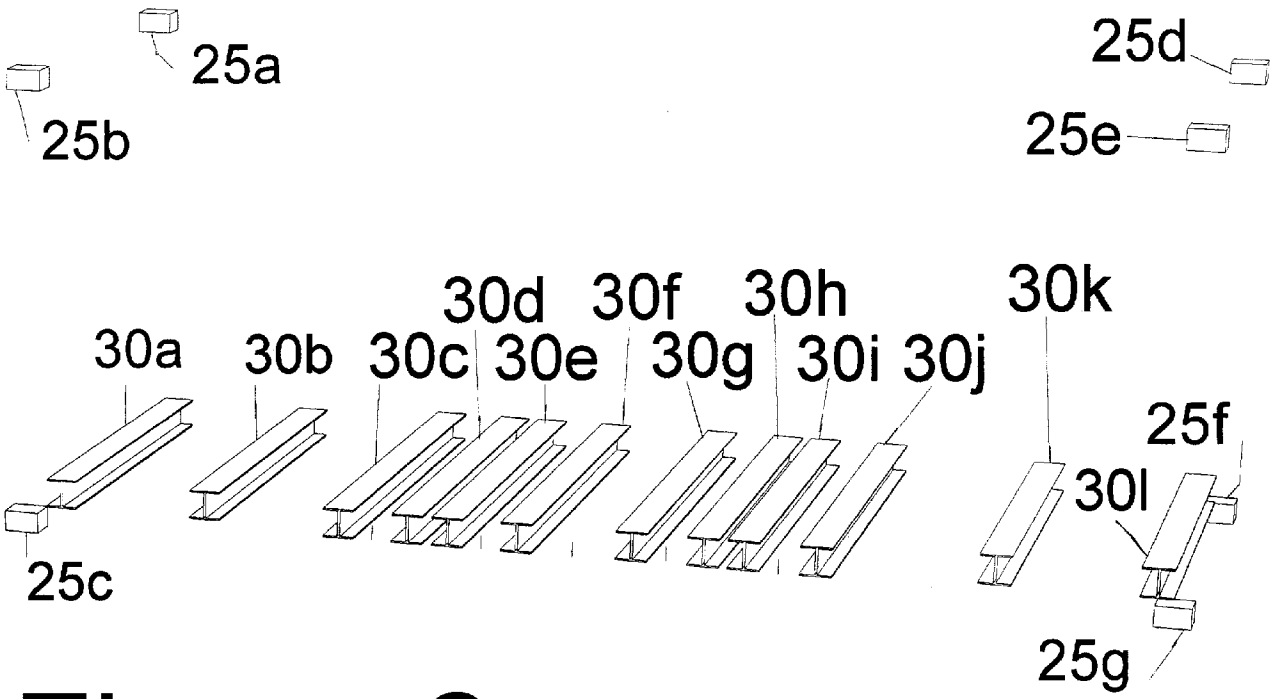
FIG. 2 is a perspective view of the corner locks and center beams of the preferred embodiment.

FIG. 2 is a perspective view of the corner locks and center beams of the preferred embodiment. Frame 40 comprises a plurality of standardized corner locks. Corner locks 25*a*, 25*b*, 25*c*, 25*d*, 25*e*, 25*f*, and 25*g* are pictured, an eighth corner lock is not visible. Center beams 30*a*, 20*b*, 30*c*, 30*d*, 30*e*, 30*f*, 30*g*, 30*h*, 30*i*, 30*j*, 30*k*, and 30*l* support plenum 15 when container 5 is in the horizontal orientation or "first orientation". Corner locks (also "corner fittings") of the presently preferred embodiment conform to ISO 1161, a standard defining placement, size, apertures and other details of such corner locks, and incidentally thereby serve to help define the dimensions of the overall container 5.

In particular, a number of dimensions may be defined.

S=Length, measured between centers of apertures in corner locks.

P=Width, as measured between centers of apertures in corner locks.

L=Overall length of container.

W=Overall width of container.

H=Overall height of container.

D=Diagonal distance between centers of apertures on the same surface of the container, thus resulting in six measurements: $D_1$ through $D_6$.

K=Absolute value of difference between two "D" values taken from one surface of the container, that is, a measurement of how far from exactly rectangular a container surface is, and thus a measurement of the error in size or shape of the container.

$C_1$=Corner lock length.

$C_2$=Corner lock width.

These values in turn allow the creation of standardized containers in certain shapes and sizes, four such sizes are given below. The following are all "sub-embodiments" of the preferred and alternative embodiments, chosen for conformity to standards such as ISO 1496 and 1161. The purpose in providing sub-embodiments chosen to fit a standard is to provide an enhanced ease of use of the device embodiment of the invention.

It is further worth understanding that overhead space considerations at present day facilities may play a role in selecting preferred embodiments. At the present time, a 20 foot (6 meter) embodiment such as detailed on the table below is the best mode now contemplated. However, other lengths may be desirable at other times or for other applications of the invention. For example, a 10 foot (3 meter) length embodiment allows erection of the container with relatively minimal overhead space requirements. On the other hand, a 40 foot (12 meter) length embodiment provides greater capacity.

In other embodiments, details not related to standardized container sizes may be altered. For example, in embodiments the composition, number, placement and location of the bridge beams may be altered to suit needs.

Thus the embodiments shown below in reference to standard container sizes may be preferred or less preferred depending upon circumstances.

TABLE 1

| | Dimensions and tolerances | | | |
|---|---|---|---|---|
| | 10 ft container mm (ft, in.) | 20 ft container mm (ft, in.) | 30 ft container mm (ft, in.) | 40 ft container mm (ft, in.) |
| Length (external) s | $2991_{-3}^{+0}$ (9 ft $9\frac{3}{4}_{-3/16}^{+0}$ in.) | $6058_{-6}^{+0}$ (19 ft $10\frac{1}{2}_{-1/4}^{+0}$ in.) | $9124_{-10}^{+0}$ (29 ft $11\frac{1}{4}_{-3/8}^{+0}$ in.) | $12192_{-10}^{+0}$ (40 ft $0_{-3/8}^{+0}$ in.) |
| | 2787 (9 ft $1\frac{23}{32}$ in.) | 5853 (19 ft $2\frac{7}{16}$ in.) | 8918 (29 ft $3\frac{1}{8}$ in.) | 11985 (39 ft $3\frac{7}{9}$ in.) |
| Width | $2438_{-5}^{+0}$ (8 ft $0_{-3/16}^{+0}$ in.) | $2438_{-5}^{+0}$ (8 ft $0_{-3/16}^{+0}$ in.) | $2438_{-5}^{+0}$ (8 ft $0_{-3/16}^{+0}$ in.) | $2438_{-5}^{+0}$ (8 ft $0_{-3/16}^{+0}$ in.) |
| P | 2259 (7 ft $4\frac{31}{32}$ in.) | 2259 (7 ft $4\frac{31}{32}$ in.) | 2259 (7 ft $4\frac{31}{32}$ in.) | 2259 (7 ft $4\frac{31}{32}$ in.) |
| Height | $2438_{-5}^{+0}$ (8 ft $0_{-3/16}^{+0}$ in.) | $2438_{-5}^{+0}$ (8 ft $0_{-3/16}^{+0}$ in.) | $2438_{-5}^{+0}$ (8 ft $0_{-3/16}^{+0}$ in.) | $2438_{-5}^{+0}$ (8 ft $0_{-3/16}^{+0}$ in.) |
| | $2591_{-5}^{+0}$ (8 ft $6_{-3/16}^{+0}$ in.) | $2591_{-5}^{+0}$ (8 ft $6_{-3/16}^{+0}$ in.) | $2591_{-5}^{+0}$ (8 ft $6_{-3/16}^{+0}$ in.) | $2591_{-5}^{+0}$ (8 ft $6_{-3/16}^{+0}$ in.) |
| | $2743_{-5}^{+0}$ (9 ft $0_{-3/16}^{+0}$ in.) | $2743_{-5}^{+0}$ (9 ft $0_{-3/16}^{+0}$ in.) | $2743_{-5}^{+0}$ (9 ft $0_{-3/16}^{+0}$ in.) | $2743_{-5}^{+0}$ (9 ft $0_{-3/16}^{+0}$ in.) |
| | $2896_{-5}^{+0}$ (9 ft $6_{-3/16}^{+0}$ in.) | $2896_{-5}^{+0}$ (9 ft $6_{-3/16}^{+0}$ in.) | $2896_{-5}^{+0}$ (9 ft $6_{-3/16}^{+0}$ in.) | $2896_{-5}^{+0}$ (9 ft $6_{-3/16}^{+0}$ in.) |
| $K_1$ (max) | 10 ($\frac{3}{8}$ in.) | 13 ($\frac{1}{2}$ in.) | 16 ($\frac{5}{8}$ in.) | 19 ($\frac{3}{4}$ in.) |
| $K_2$ (max) | 10 ($\frac{3}{8}$ in.) | 10 ($\frac{3}{8}$ in.) | 10 ($\frac{3}{8}$ in.) | 10 ($\frac{3}{8}$ in.) |

Figure 3:
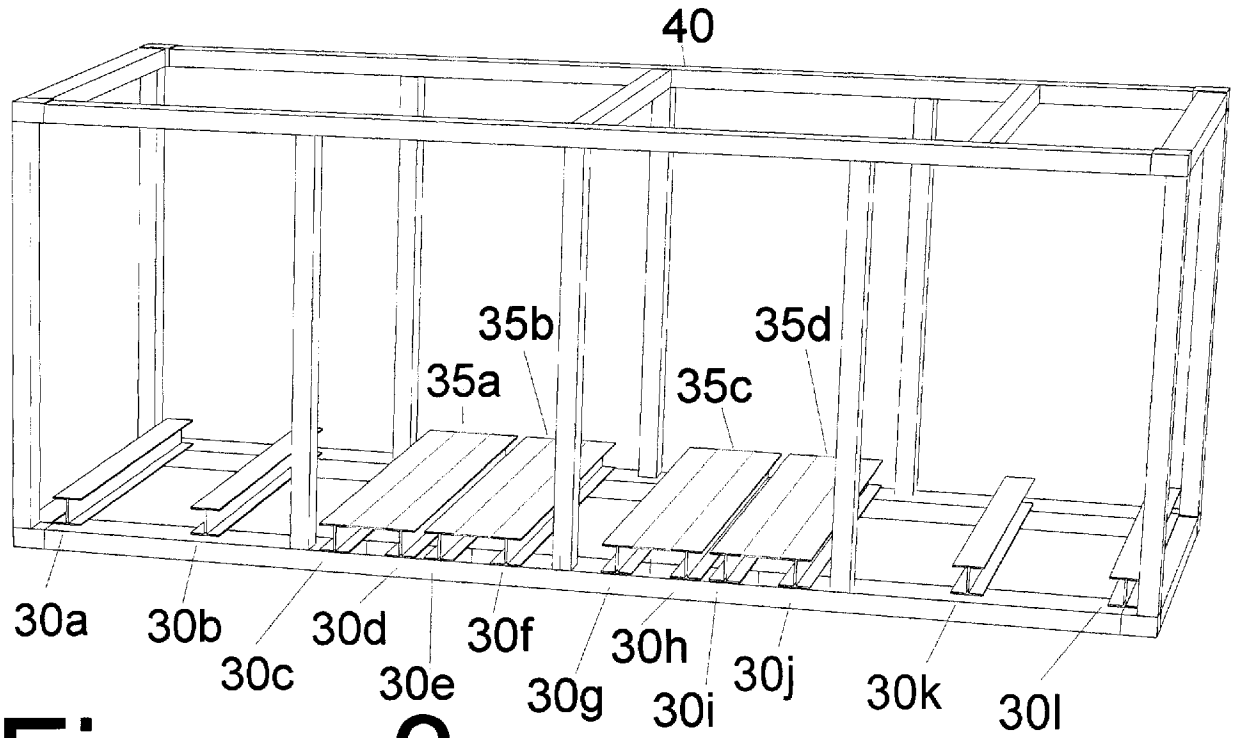
FIG. 3 is a perspective view of the framework of the preferred embodiment, including the corner locks and center beams.

FIG. 3 is a perspective view of the framework of the preferred embodiment, including the corner locks and center beams. It may be seen that bridge beams 35*a*, 35*b*, 35*c* and 35*d* are added between certain of the center beams. By means of these bridge beams, the unit may be picked up and handled by various types of handling equipment such as fork lifts of various sizes. It may also be safely emplaced upon "castings" or "tie downs", generally any of a wide variety of protrusions from the beds of trailers or decks of ships, etc, which allow fast and easy fastening of the container to the vehicle. Numerous other methods of handling of the containers are possible. For example, the corner locks are utilized as standardized handling points or strong points, allowing the container to be manipulated by a number of devices well known in the art and specifically adapted for such use. Gantries, cranes, lifts and other handling equipment allow intermodal transfer to a wide variety of vehicles: trucks, trains, ships, aerial vehicles and so on. By these means, once "packaged" into the container 5, the grain or other dry particulate bulk product inside may be transported to a great number of locations world-wide without any type of secondary or tertiary handling.

It is important to remember that container 5 has strength sufficient to withstand being elevated from a horizontal orientation to an at least partially vertical orientation while loaded with such cargo. In the presently preferred embodiment, the plenum is supported by a framework and gains from the framework said strength sufficient to withstand being elevated from a horizontal orientation to an at least partially vertical orientation while loaded with such cargo. In the best mode now contemplated, the framework is external to the plenum.

Figure 4:
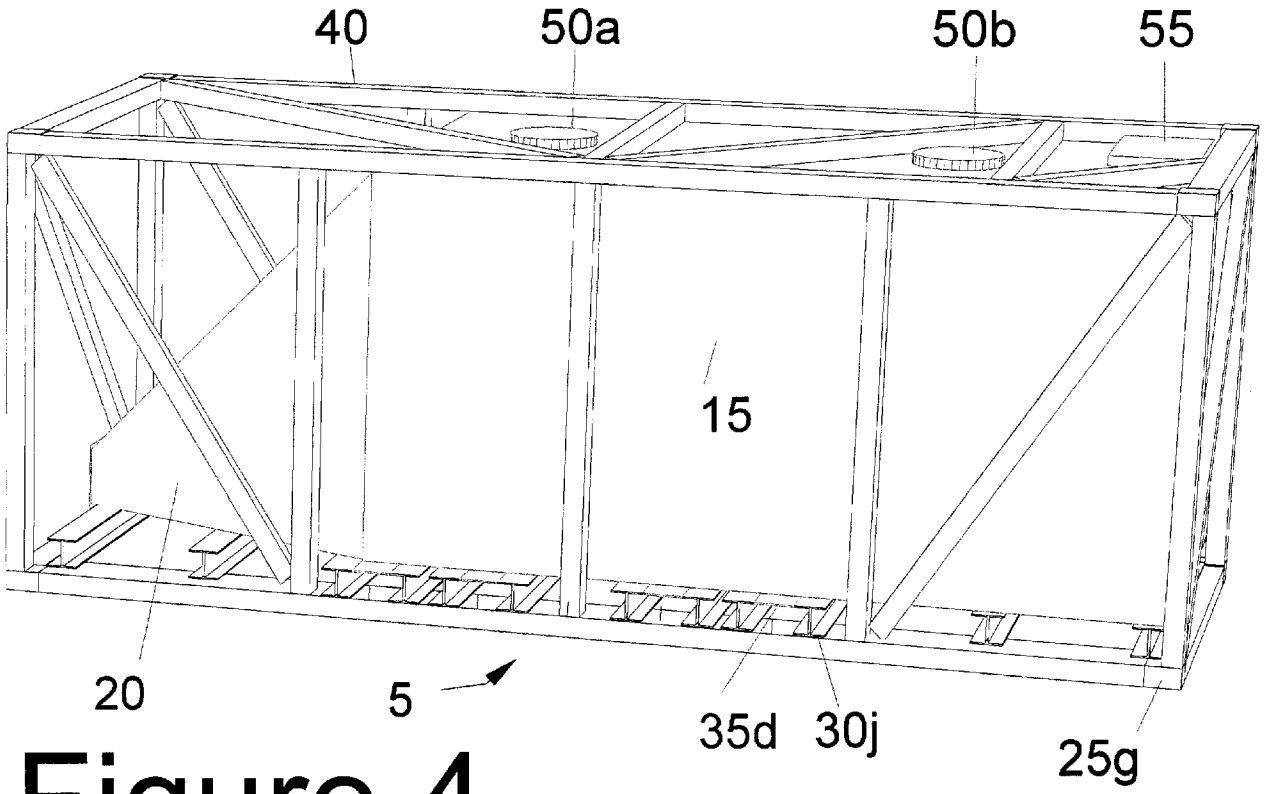
FIG. 4 is a perspective view of the container of the invention according to the preferred embodiment, sans slide gate.

FIG. 4 is a perspective view of the container of the invention according to the preferred embodiment, sans slide gate. Container 5 has plenum 15 which has at one end chute 20. Chute 20 has an irregular interior which forms a contiguous space with the interior of plenum 15. Exemplary corner lock 25*g*, exemplary center beam 30*j*, and exemplary bridge beam 35*d* are all components of frame 40 which serves to provide structural integrity to container 5. By the use of such a framework, the thickness of the walls of plenum 15 and chute 20 may decreased and thus the overall weight of container 5 may be reduced.

Additional aspects of container 5 may be discussed, in particular feed hatches 50*a* and 50*b*, and access door 55. Feed hatches 50*a*, 50*b* and access door 55 are located at the top of container 5/plenum 15 when the container 5/plenum 15 is/are in the horizontal orientation.

Feed hatches 50*a* and 50*b* (and other additional feed means located upon the top surface of container 5) may be used to fill the interior space of plenum 15 and chute 20 in a conventional manner known in the art, when container 5 is in the horizontal orientation shown in FIG. 4. That is, the vehicle on which container 5 is being conveyed may be brought under a filling device of conventional type (not shown) and grain or other dry particulate or bulk powder may be fed through feed hatches 50*a*, 50*b* until the desired degree of filling is achieved.

Access door 55 is dimensioned and configured to allow convenient human access, entry to and egress from the interior of plenum 15/container 5. This allows easier maintenance, cleaning, refurbishment, modification and other necessary activities. In addition, should problems or emergencies arise during use of container 5, access door 55 may be used.

Figure 5:
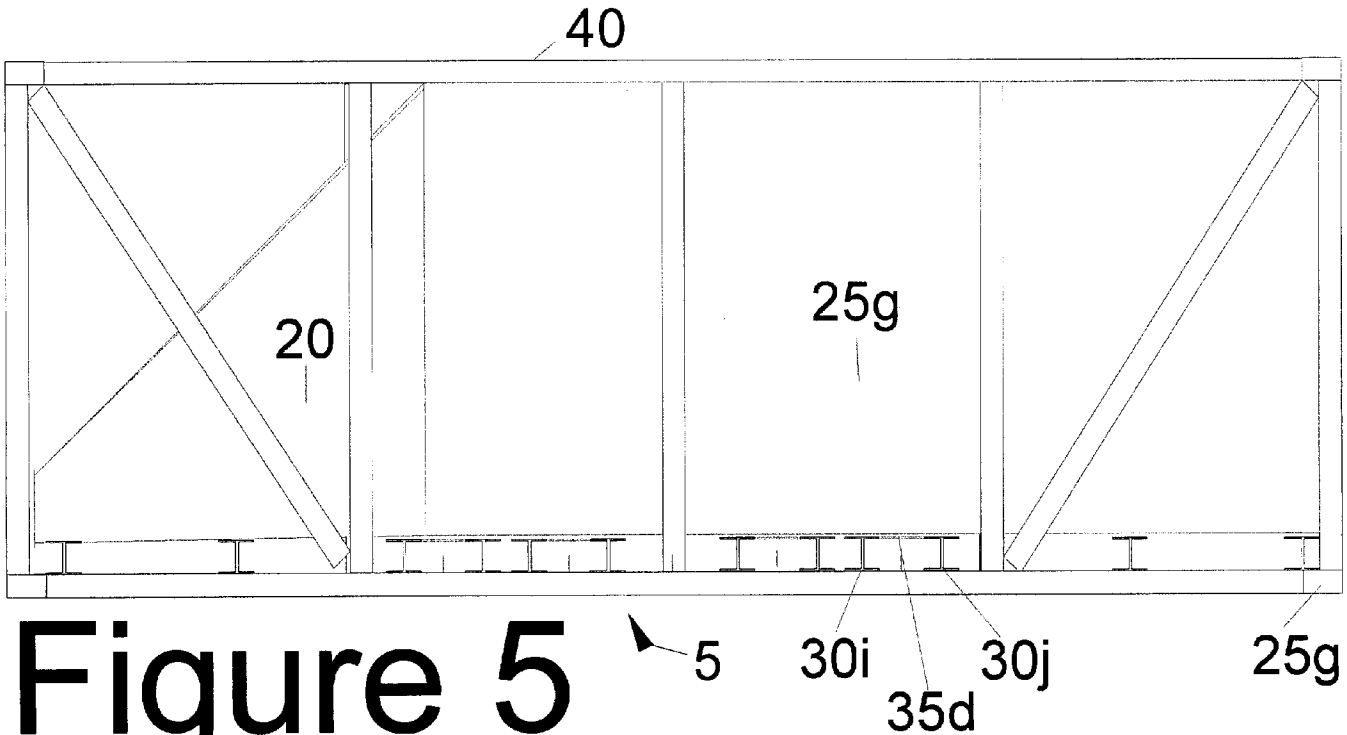
FIG. 5 is a side view of the container of the invention according to the preferred embodiment.
Figure 6:
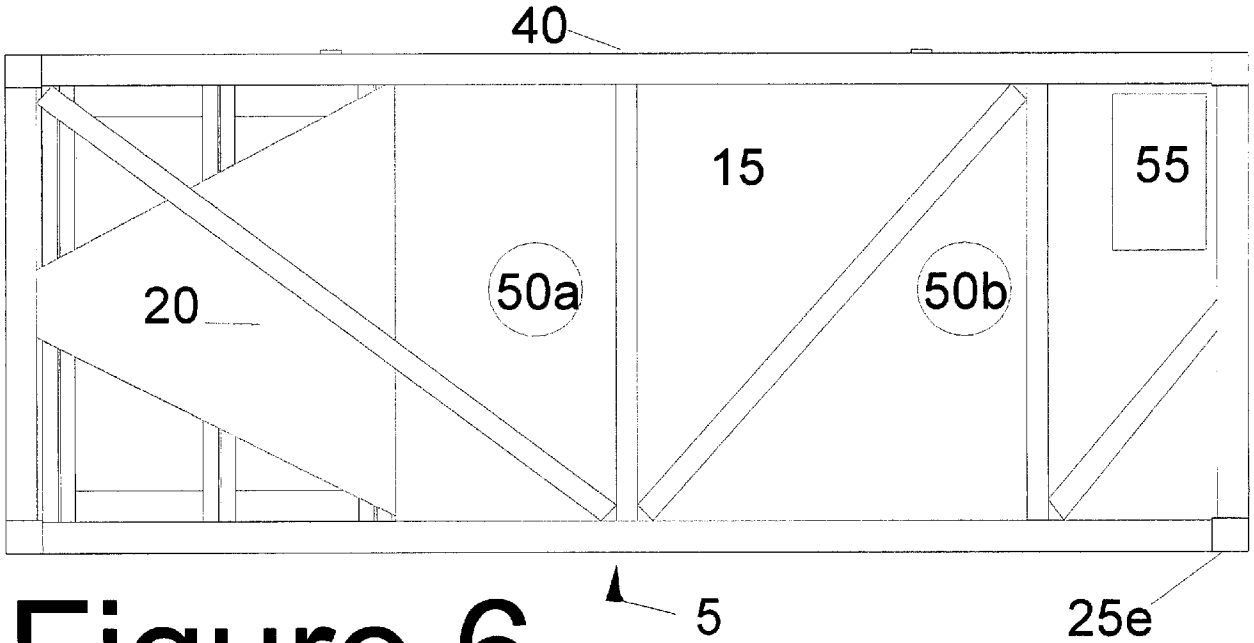
FIG. 6 is a top view of the container of the invention according to the preferred embodiment.

FIG. 5 is a side view of the container of the invention according to the preferred embodiment. It may be seen that exemplary bridge beam 35*d* entirely spans the gap between center beams 30*i* and 30*j*, although as stated above other arrangements are possible within the scope of the invention. Framework 40 comprises least one beam 35*d* dimensioned and configured to receive a lifting device, the beam/s (such as beam 35*d*) having strength sufficient to support container 5 while container 5 is elevated from a horizontal orientation to an at least partially vertical orientation while loaded with such cargo. FIG. 6 is a top view of the container of the invention according to the preferred embodiment, showing another view of fill hatches 50*a* and 50*b* and access door 55. Hatches 50*a*, 50*b* may be dimensioned and configured to cooperate with standardized discharge chutes on loading facilities to which the device embodiment of the invention is taken.

Figure 7:
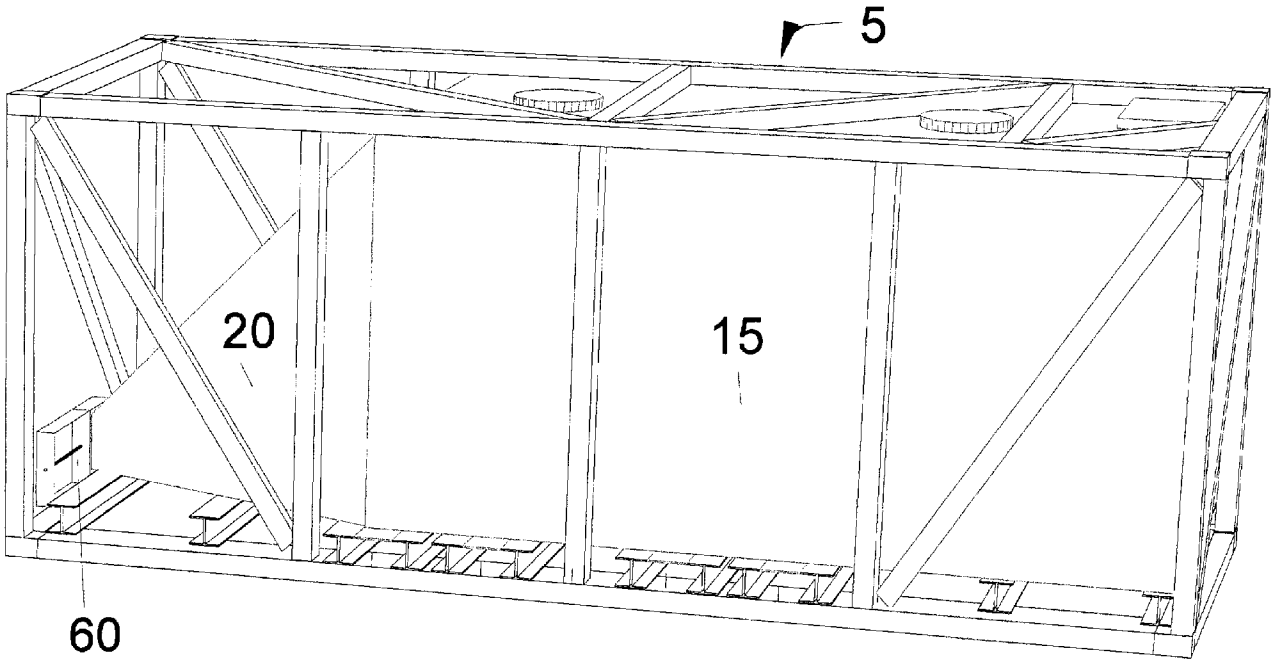
FIG. 7 is a perspective view of the container of the invention according to the preferred embodiment, showing the slide gate.

FIG. 7 is a perspective view of the container of the invention according to the preferred embodiment, showing the slide gate. Slide gate 60 or another type of closure such as a valve, gate, door, or hatch may be used to meter, allow or shut off flow of the bulk dry particulate materials from the interior of container 5 when discharging cargo therefrom. Slide gate 60 has at least a first closed position in which dry particulate bulk cargo may not flow out of container 5 via chute 20, and a second open position in which dry particulate bulk cargo may flow out of container 5 at a first flow rate or rate of flow. Slide gate 60 may also have a third intermediate position in which dry particulate bulk cargo may flow out of the container at a second rate of flow. This is important, as an uncontrolled flow may overwhelm certain types or models of receiving devices.

Figure 8:
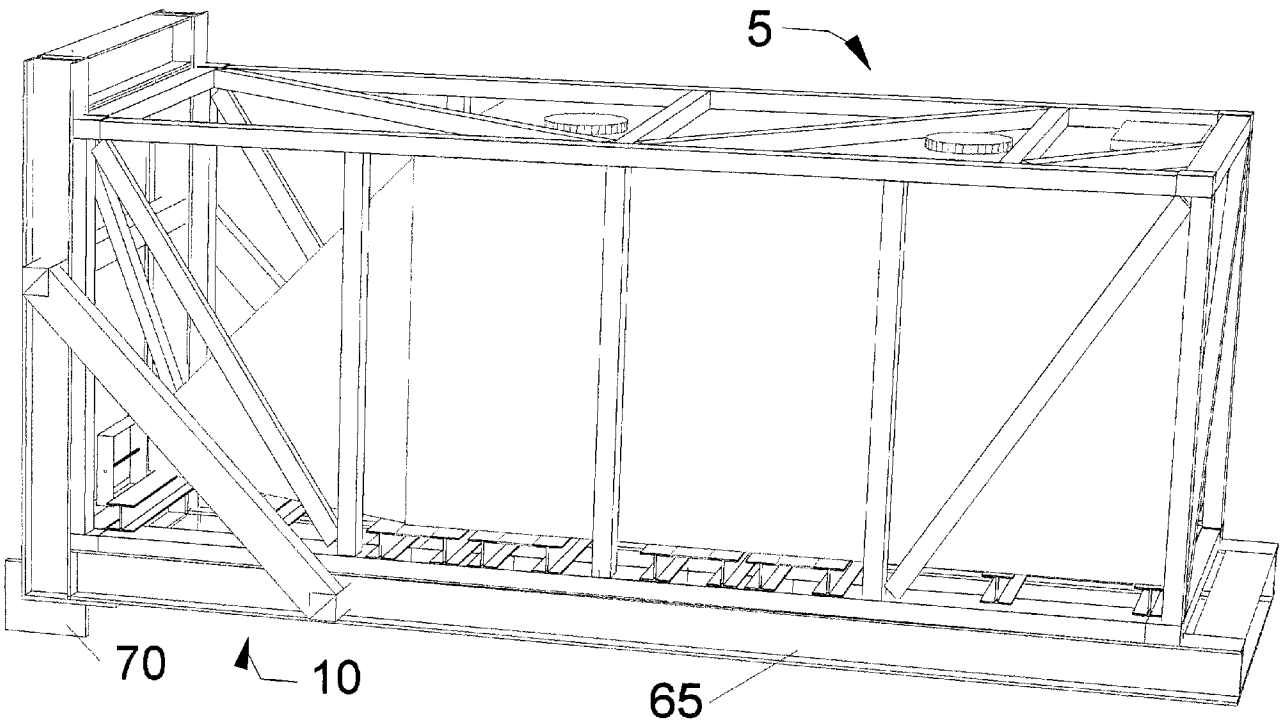
FIG. 8 is a perspective view of the container of the invention according to the preferred embodiment, placed into a cradle in the horizontal orientation.

FIG. 8 is a perspective view of the container of the invention according to the preferred embodiment, placed into a cradle in the horizontal orientation. Cradle 10 comprises cradle frame 65 and hinge plate 70. Cradle 10 is dimensioned and configured to receive and support plenum 15 into cradle 10. Plenum 15 is supported by cradle framework 65 and gains from cradle frame/framework 65 said strength sufficient to withstand being elevated from a horizontal orientation to an at least partially vertical orientation while loaded with such cargo. Hinge plate 70 and another symmetrical hinge plate (not visible) are located on the cradle at each lower corner of the first end of cargo container 5 when cargo container 5 is present in cradle frame 65.

Figure 9:
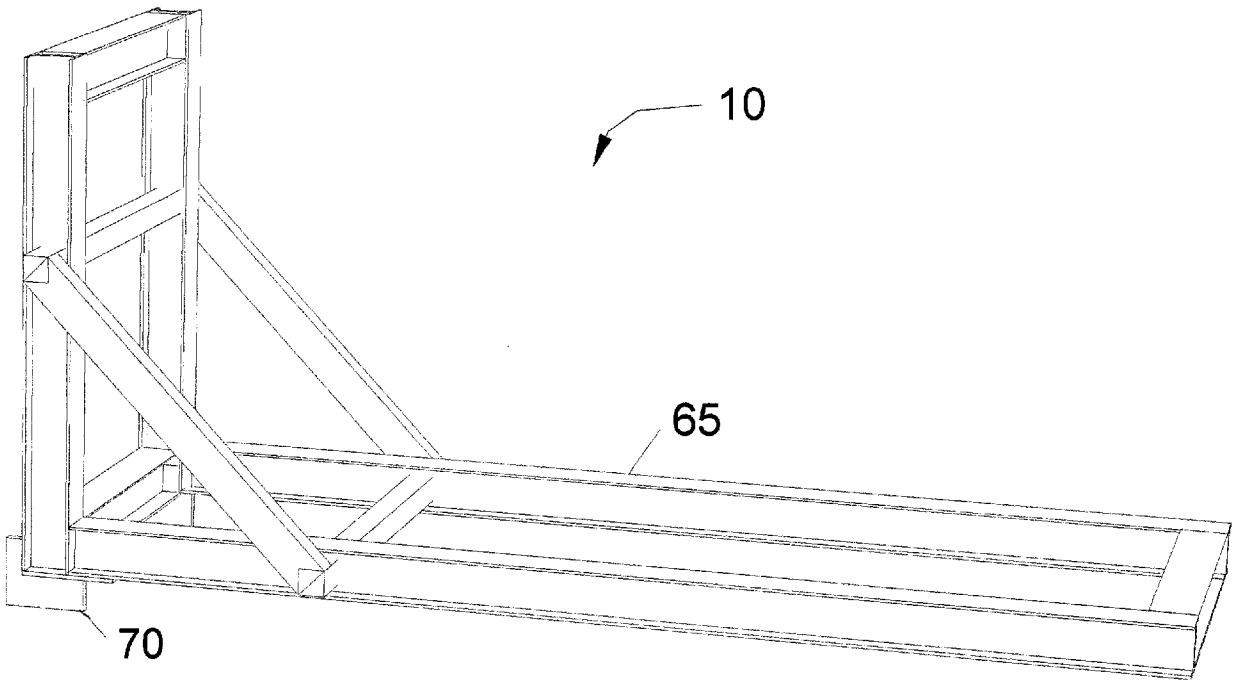
FIG. 9 is a perspective view of the cradle of the invention according to a second embodiment of the invention.

FIG. 9 is a perspective view of the cradle of the invention according to a second embodiment of the invention, that is, a cradle without a specific container placed therein. In this embodiment also, cradle 10 comprises cradle frame 65 and hinge plate 70.

Figure 10:
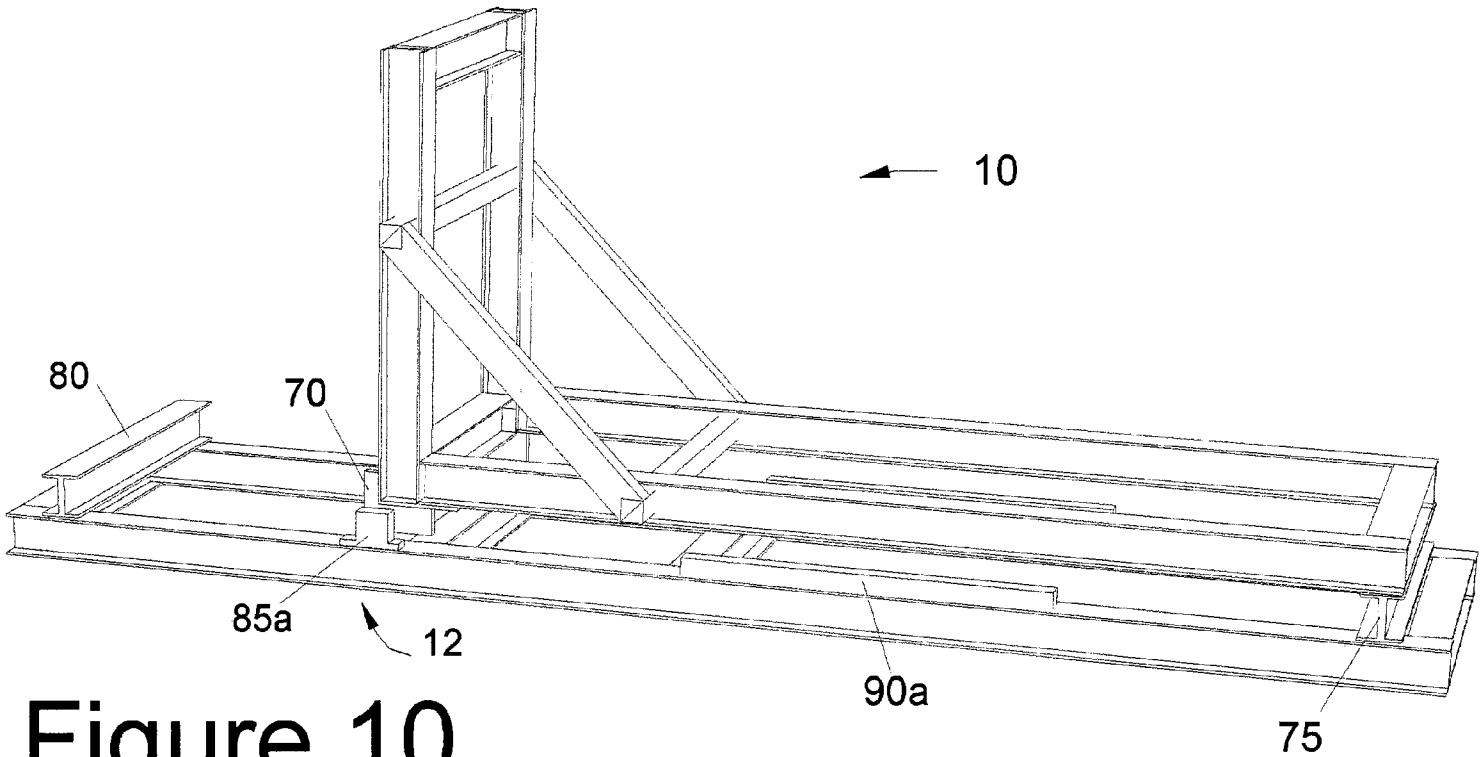
FIG. 10 is a perspective view of the cradle of the invention placed on an erector according to a third embodiment of the invention.
Figure 11:
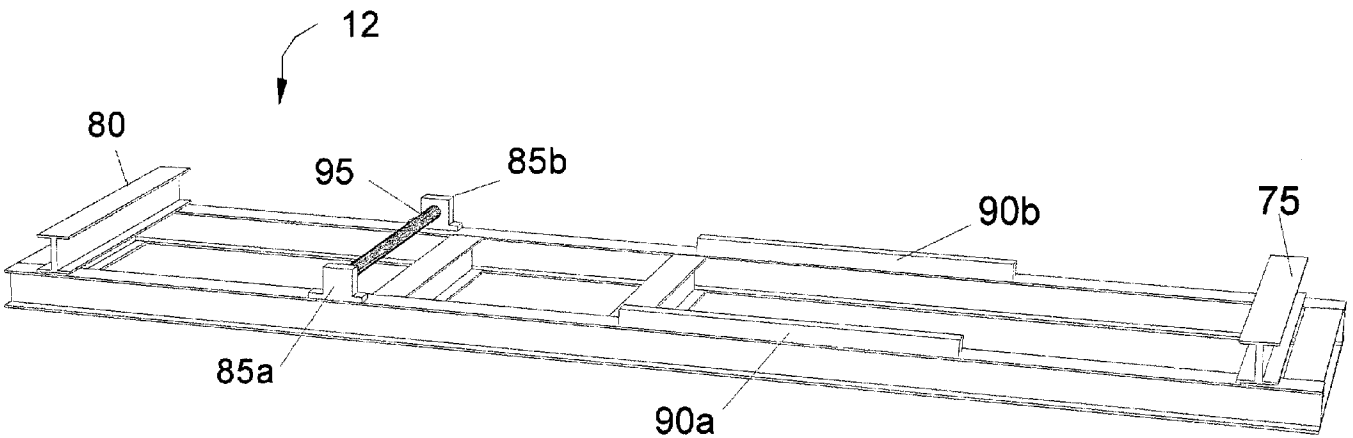
FIG. 11 is a perspective view of the erector of the invention according to the third embodiment.

FIG. 10 is a perspective view of the cradle of the invention placed on an erector according to a third embodiment of the invention. Cradle 10 is placed on erector 12 and secured thereto by means of container locks such as exemplary container lock 90*a*, with its weight resting via hinge plate 70 on exemplary hinge block 85*a* and leveling rest 75 or leveling rest 80 depending upon the orientation of cradle 10. In the horizontal orientation pictured in FIG. 10, the weight of cradle 10 rests on hinge block 85*a* and leveling rest 75. FIG. 11 is a perspective view of erector 12 of the invention according to the third embodiment, without cradle 10 thereon. Hinge block 85*b*, container lock 90*b*, and hinge shaft 95 are visible. Erector 12 is dimensioned and configured to receive and support cradle 10, erector 12 also having at least two hinge blocks 85*a* and 85*b* and at least one hinge shaft 95 supported between hinge blocks 85*a*, 85*b*, hinge shaft 95 being dimensioned and configured such that when erector 12 receives and supports cradle 10, hinge plates (for example hinge plate 70) are welded onto hinge shaft 95 and may rotate freely therewith. Shaft 95 sits in hinge blocks 85*a*, which may be a bearing case, and may specifically be a pillow block bearing case. Thus, shaft 95 rotates freely in hinge block 85*a*.

Hinge shaft 95 may be 4 inches in diameter (10 cm) in the preferred embodiment, at which thickness it is suitable for receiving 40,000 to 50,000 lbs (roughly 18,000–22,000 kg) of weight. However, the device is not so limited and a hinge shaft might be much bigger in embodiments, so as to achieve much greater weight (a one foot diameter shaft (30 cm) might support up to 250,000 lbs).

Figure 12:
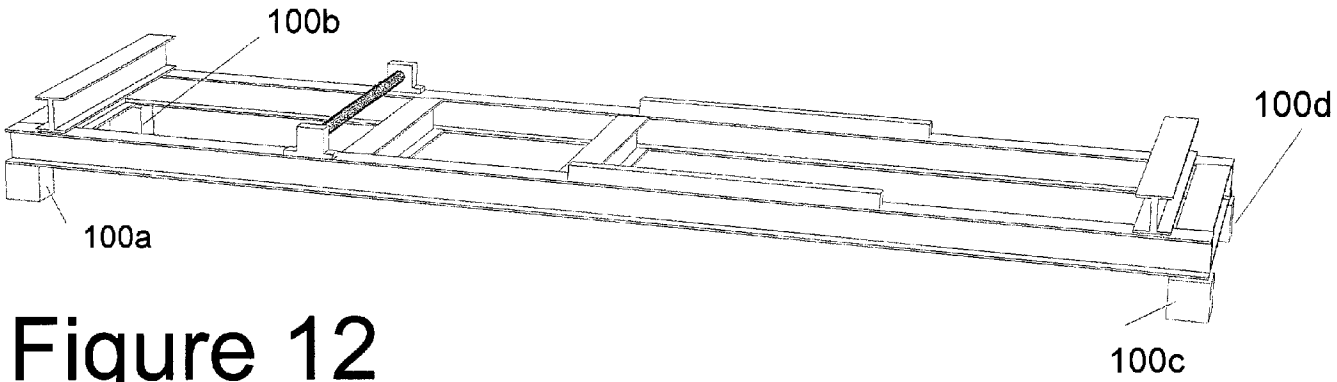
FIG. 12 is a perspective view of the erector of the invention according to a fourth embodiment having load cells under each corner.

FIG. 12 is a perspective view of the erector of the invention according to a fourth embodiment having load cells under each corner. Erector 12 is supported by load cells 100*a*, 100*b*, 100*c* and 100*d*, which may be structural members only or may be used to measure the weight or mass of the contents of erector 12. Use of multiple component scales to measure weight is well known in this art field. A plurality of load cells such as load cell 100*a*, etc, wherein the weight of the erector 12, cradle 10, container 5 and cargo rest upon the load cells, and wherein the load cells further comprise at least one scale to measure the weight resting upon the load cells, or to measure an incremental weight change of the container indicating an incremental discharge from the container and combinations thereof, which greatly eases discharge/drain of a measured quantity of cargo.

Figure 13:
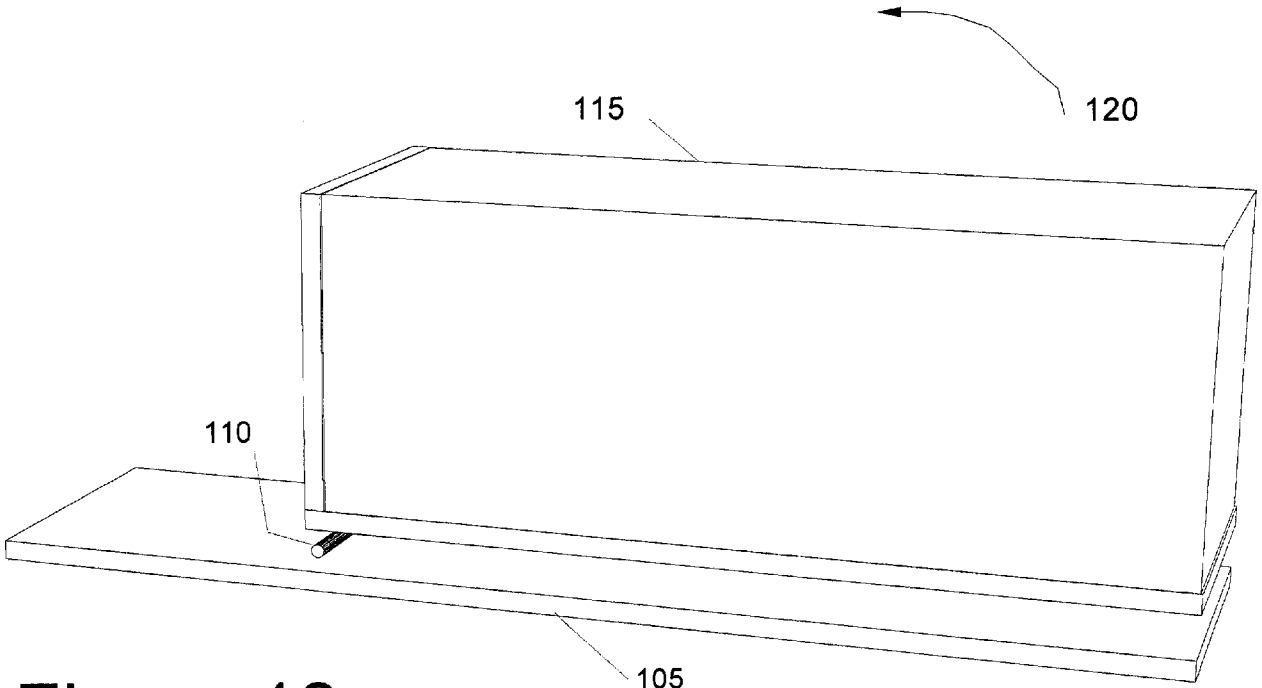
FIG. 13 is an analytical block diagram in perspective view of the method of the invention according to a fifth embodiment thereof.
Figure 14:
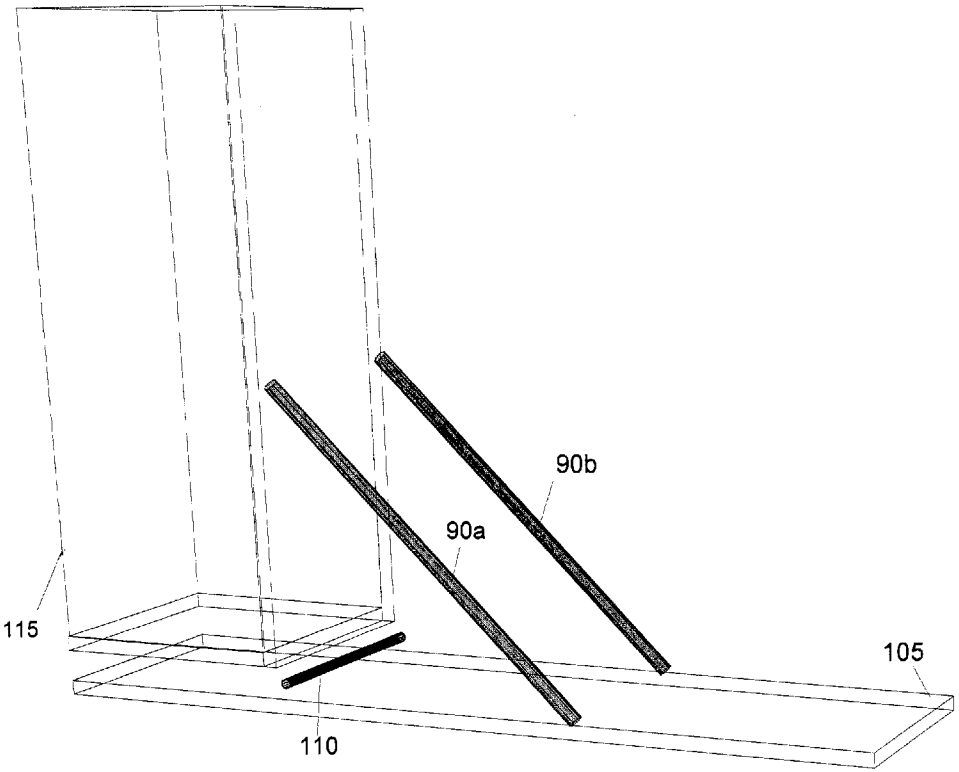
FIG. 14 is an analytical block diagram in perspective view of the method of the diagram according to the fifth embodiment thereof.

While the invention has been depicted as a device, it will be appreciated that it may more broadly be considered to be either a method or a device. FIG. 13 is an analytical block diagram in perspective view of the method of the invention according to a fifth embodiment thereof. Erector 105 supports via hinge shaft 110 the weight of container assembly 115. As shown by arrow 120, container assembly 115 may rotate or be rotated about hinge shaft 110. FIG. 14 is an analytical block diagram in perspective view of the method of the diagram according to the fifth embodiment thereof, when the container assembly 115 is erected to a vertical orientation (or "second orientation"). Struts 125 may either assist in the rotation operation or may be passive supports used to hold container assembly 115 in place at an angle to the horizontal.

While container assembly 115 is pictured in this analytical diagram as a simple prism, it will be appreciated that it may be a composite of, for example, container 5 and cradle 10 or other similar devices having the ability to be unloaded in a vertical orientation. Container 5 may in other embodiments be a cubical body, or may have a pyrimidal chute, or a cylindrical body having a conical chute or other suitable shapes, all of which fall within the scope of the attached claims. Irregular shapes may be used as well, such as a cylindrical body having a flat bottom, a skewed conical chute, etc. While container assembly 115 is pictured at an angle of 90 degrees to the horizontal, it will be appreciated that the term "vertical orientation" as used herein includes any angle sufficiently great so as to overcome the angle of repose of the dry particulate bulk cargo and the internal geometry of plenum 15 and chute 20 or equivalent device and cause enhanced flow of the dry particulate bulk cargo from the interior of container assembly 115.

In the method of operation of the invention, the following steps may be carried out.

1) A container having feed hatches on the top surface and a closed chute at a first end may be placed on a vehicle adapted to the transportation of standardized containers. The container may be oriented horizontally (conventionally) upon such transport vehicle.

2) On the vehicle, the container may be brought to a conventional grain loading facility in a horizontal orientation, in which orientation it may be filled via the feed hatches on the top surface, that is, filled from the top. Such facilities are common and usually employ a discharge chute or a long side-loading chute to bring grain over the vehicle and container, and then drop it through the feed hatch or feed hatches.

3) The container may then be transported on such transport vehicle to a location at which the discharge of the cargo is desired. Such transportation may involve more than one mode of travel, for example, a container originally filled while on a train car may be later transferred to a ship, taken to another location, off-loaded onto a truck and transported again. Details of the intermediate transport of standardized containers are well known in the art.

4) The container may then be placed into a cradle, and the cradle placed into an erector, or in the alternative a container assembly may be placed directly into an erector.

5) The container and container assembly may then be re-oriented into a substantially vertical or at least elevated orientation. Elevating a second end of the container enables the next step.

6) Opening of the chute allows dry bulk particulate cargo to flow/drain/discharge out of the interior of the container/container assembly from the first end. Note that it is extremely advantageous to meter out the amount discharged and especially the flow rate of the discharge, so as to avoid overwhelming the receiving devices located below the chute. Such receiving devices may be conveyors, hoppers, pipes, tubing, other containers, buildings, vehicles and so on. In one embodiment, the dry particulate cargo may be allowed to fall straight down into the open top of a vehicle brought to a position directly beneath the elevated container/assembly. Discharging such container by means of the chute located at such first end of the container may allow the discharge to proceed without special equipment.

7) Load cells may indicate the amount of cargo discharged, aiding in off-loading metered quantities of material.

8) The chute may be closed when the desired amount of cargo is off-loaded.

9) The container may be returned to the horizontal position, thus allowing it to be transported or re-used again.

It will be appreciated that the present invention may be used in numerous facilities already in existence, greatly decreasing the cost and speed of acceptance of the invention.

Alternative embodiments of device and method are possible without departing from the scope of the invention. A hydraulic or electrical lift may be "built-into" the container, framework, cradle, or erector. The container may be a single unit, or the container and cradle may be a single unit, or the cradle and erector may be a single unit, or the container, cradle and erector may be a single unit.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A bulk dry particulate cargo container comprising:

a first end of the cargo container having two lowers corners;

a plenum having a top and a first end of the plenum, the plenum further having at least one chute located at the first end; the plenum further having at least one feed hatch located at the top, a flat bottom of the plenum;

a framework, the plenum supported by the framework;

the container having strength from the framework sufficient to withstand being elevated from a horizontal orientation to an at least partially vertical orientation while the container is loaded;

a cradle having a cradle framework, the cradle being dimensioned and configured to receive and support the plenum into the cradle, the cradle further comprising at least one hinge plate located at each lower corner of the two lower corners of the first end of the cargo container when the cargo container is present in the cradle and;

an erector dimensioned and configured to receive and support the cradle, the erector having at least two hinge blocks and at least one hinge shaft supported between the hinge blocks, the hinge shaft being dimensioned and configured such that when the erector receives and supports the cradle, the at least one hinge plate rest upon the hinge shaft and rotate freely therewith.

2. The cargo container of claim 1, wherein the framework is external to the plenum.

3. The container of claim 1, wherein the chute further comprises:

a closure selected from the group consisting of: slide gate, valve, gate, door, hatch, and combinations thereof;

the closure having at least a first closed position and a second open position.

4. The container of claim 3, wherein the closure further has a third intermediate position.

5. The container of claim 1, further comprising:

an access door, dimensioned and configured for convenient access to the plenum.

6. The container of claim 1, wherein the framework further comprises:

a plurality of standardized corner locks.

7. The container of claim 1, wherein the framework further comprises:

at least one bridge beam, the beam having strength sufficient to support the container while the container is elevated from a horizontal orientation to an at least partially vertical orientation while loaded.

8. The container of claim 1, wherein the erector further comprises:

a plurality of load cells, wherein a weight of the erectors cradle, container and cargo rest upon the load cells, and wherein the load cells further comprise at least one scale to measure one member selected from the group consisting of: the weight resting upon the load cells, an incremental weight change of the container, and combinations thereof.

* * * * *